US008117771B2

(12) United States Patent
Risi

(10) Patent No.: US 8,117,771 B2
(45) Date of Patent: Feb. 21, 2012

(54) BUCKET THAT IS APPLICABLE INTERCHANGEABLY TO OPERATING MACHINES PROVIDED WITH HYDRAULIC OR ELECTRIC PLANT

(75) Inventor: Mirco Risi, San Giovanni in Persiceto (IT)

(73) Assignee: Simex SRL, San Giovanni in Perseceto (IT)

( * ) Notice: Subject to any disclaimer, the term of this patent is extended or adjusted under 35 U.S.C. 154(b) by 0 days.

(21) Appl. No.: 12/311,925

(22) PCT Filed: Aug. 30, 2007

(86) PCT No.: PCT/IB2007/002500

§ 371 (c)(1),
(2), (4) Date: Nov. 12, 2009

(87) PCT Pub. No.: WO2008/047190

PCT Pub. Date: Apr. 24, 2008

(65) Prior Publication Data

US 2010/0095561 A1 Apr. 22, 2010

(30) Foreign Application Priority Data

Oct. 20, 2006 (IT) ..... BO2006A0722

(51) Int. Cl.
*E02F 3/40* (2006.01)
*B02C 1/00* (2006.01)

(52) U.S. Cl. ..... 37/403; 241/101.72

(58) Field of Classification Search ..... 37/403, 37/411, 319, 195, 349, 341, 448, 142.5, 904, 37/117.5; 299/18, 67; 241/101.72, 101.73, 189.1, 286, 264, 285.2, 285.3, 191, 236
See application file for complete search history.

(56) References Cited

U.S. PATENT DOCUMENTS

| | | | | | |
|---|---|---|---|---|---|
| 3,343,800 | A | * | 9/1967 | Rasmussen | 241/47 |
| RE30,778 | E | * | 10/1981 | Hahn et al. | 241/18 |
| 4,852,277 | A | | 8/1989 | Ward | 37/117.5 |
| 5,379,534 | A | * | 1/1995 | Negishi | 37/379 |
| 5,485,689 | A | | 1/1996 | Jonninen | 37/189 |
| 5,619,811 | A | | 4/1997 | Yrjola | 37/466 |
| 5,887,810 | A | | 3/1999 | Maruyama | 241/189.1 |
| 5,890,666 | A | * | 4/1999 | Folling et al. | 241/189.1 |
| 6,237,865 | B1 | * | 5/2001 | Luttermann et al. | 241/101.72 |
| 6,871,807 | B2 | | 3/2005 | Rossi, Jr. | 241/101.72 |
| 6,915,972 | B2 | * | 7/2005 | Rossi, Jr. | 241/101.72 |
| 2004/0050985 | A1 | | 3/2004 | Rossi, Jr. | 241/101.72 |
| 2008/0000112 | A1 | | 1/2008 | Schenk | 31/443 |

FOREIGN PATENT DOCUMENTS

| | | |
|---|---|---|
| EP | 1 001 093 | 5/2000 |
| EP | 1 267 002 | 12/2002 |
| JP | 10030247 | 2/1998 |
| WO | WO 01/14651 | 3/2001 |

* cited by examiner

*Primary Examiner* — Robert Pezzuto
(74) *Attorney, Agent, or Firm* — Fattibene and Fattibene LLC; Paul A. Fattibene

(57) ABSTRACT

A bucket (B) that is applicable interchangeably to operating machines provided with hydraulic or electric power, equipped with one or more rotors (R) actuated by one or more hydraulic or electric (M) engines or gear motors fed by the hydraulic or electric circuit resting inside operating machines or outside the bucket.

9 Claims, 17 Drawing Sheets

BUCKET THAT IS APPLICABLE INTERCHANGEABLY TO OPERATING MACHINES PROVIDED WITH HYDRAULIC OR ELECTRIC PLANT

FIELD OF THE INVENTION

The present invention refers to the technology of equipment applied to operating machines provided with hydraulic or electric plant, and in particular to the buckets of the loading and digging machines. The international classification of reference is E 01 C.

DESCRIPTION OF THE RELATED ART

Brief Summary of the Invention

A bucket that is applicable interchangeably to operating machines provided with hydraulic or electric plant, equipped with one or more rotors actuated by one or more hydraulic or electric engines or gear motors.

Machines to crush stones or different kinds of debris are known. The problem to be solved is that of equipping operating machines of small dimensions with buckets provided with rotating crushing devices activated by engines hydraulic or electric gear motors fed by the hydraulic or electric circuit resting inside operating machines or outside the bucket.

DETAILED DESCRIPTION OF THE INVENTION

The invention is now disclosed with reference to the figures of the attached drawings, as unrestrictive example.

Figure 1:
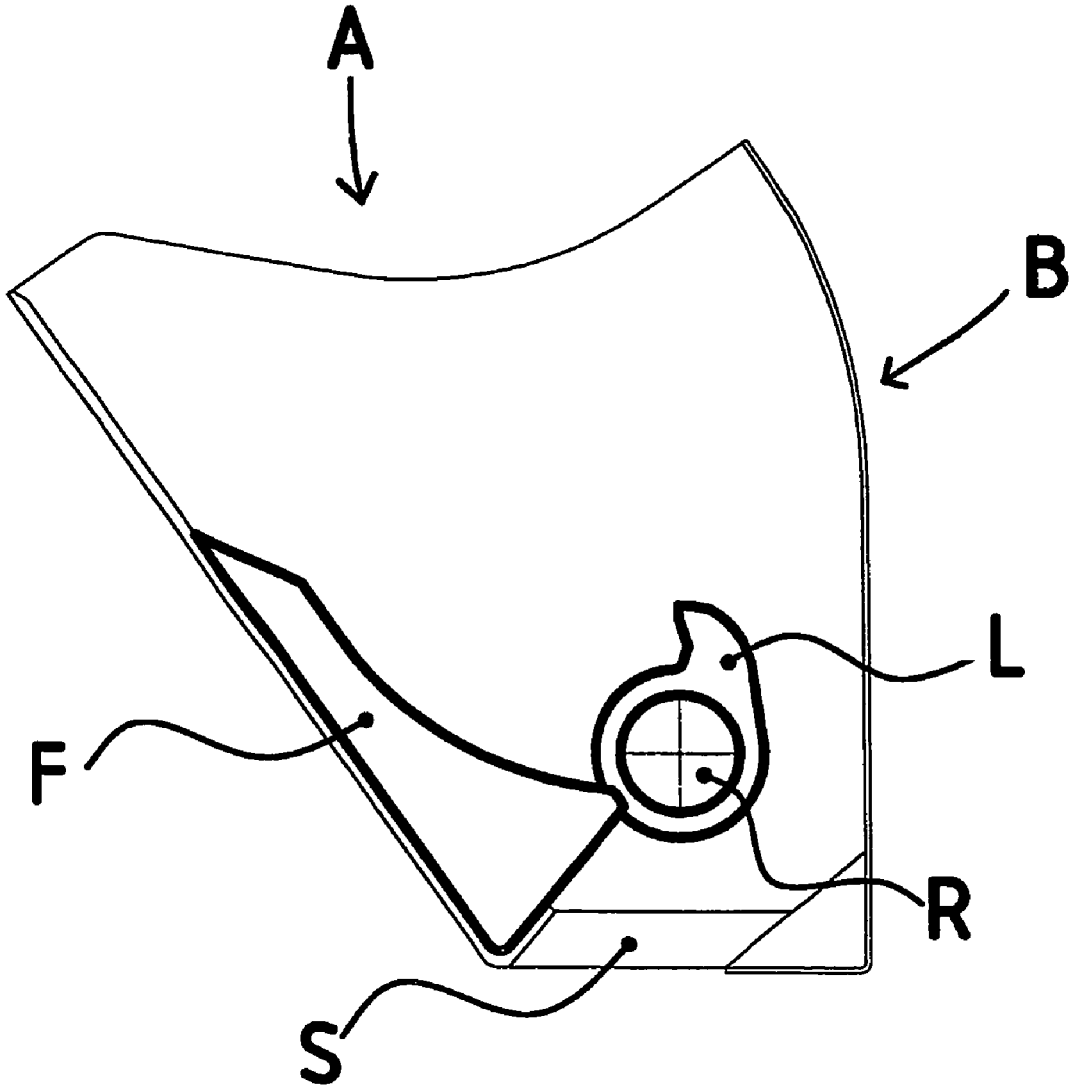
FIG. 1 shows schematically in a transverse section a bucket.

FIG. 1 shows schematically in a transversal section a bucket (B) inside which there is at least one rotor (R) provided with a crushing blade (L) that interacts with the fixed plates (F) applied inside the bucket. It can be noticed the presence of the upper feed opening (A) and of the lower emptying out mouth (S).

Figure 2:
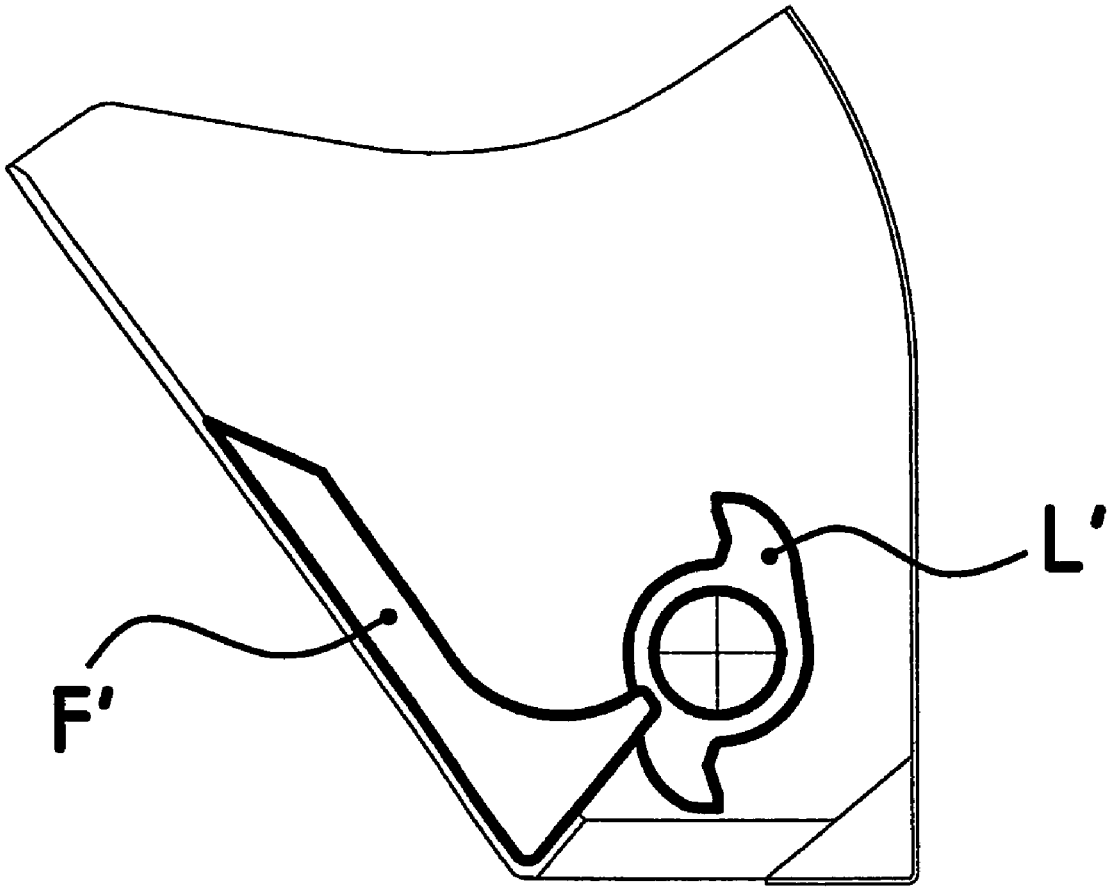
FIG. 2 shows schematically in a transverse section another bucket.

FIG. 2 shows schematically in a transversal section a bucket (B) inside which there is a rotor (R) provided with two crushing blades (L') that interact with the fixed blades (F').

Figure 3:
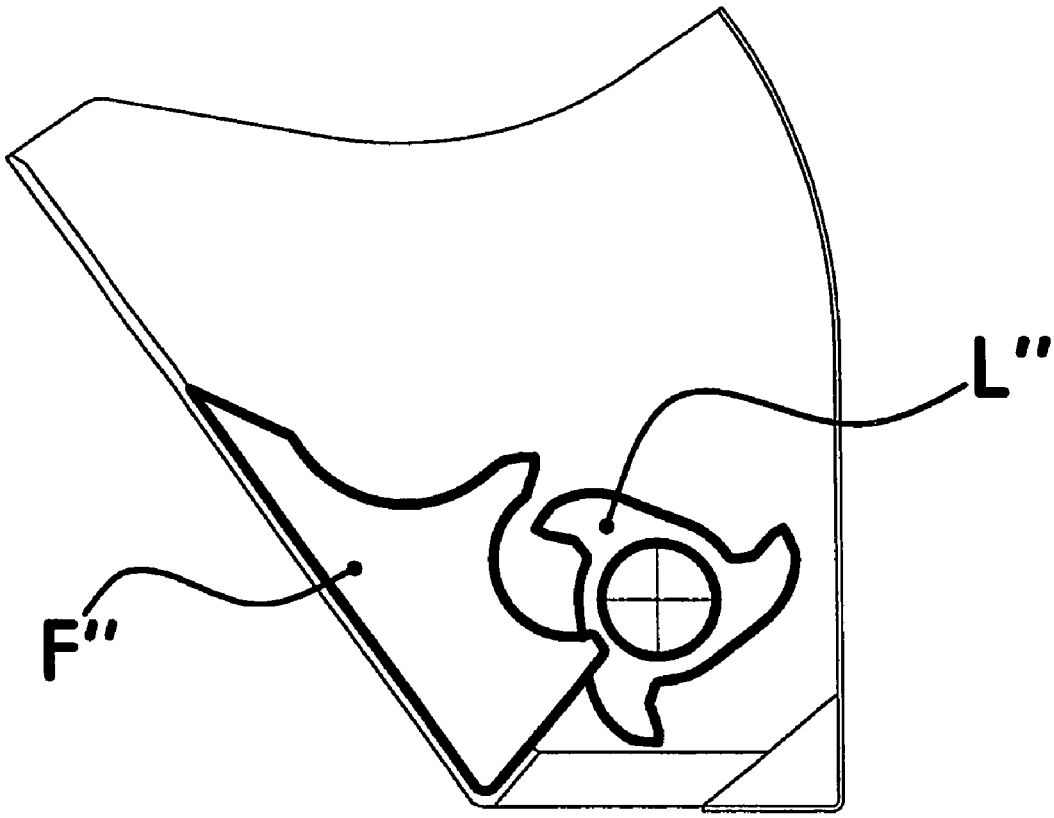
FIG. 3 shows schematically in a transverse section another bucket.

FIG. 3 shows schematically in a transversal section a bucket with the rotor provided with three crushing blades (L") that interact with fixed blades (F") that are especially shaped.

Figure 4:
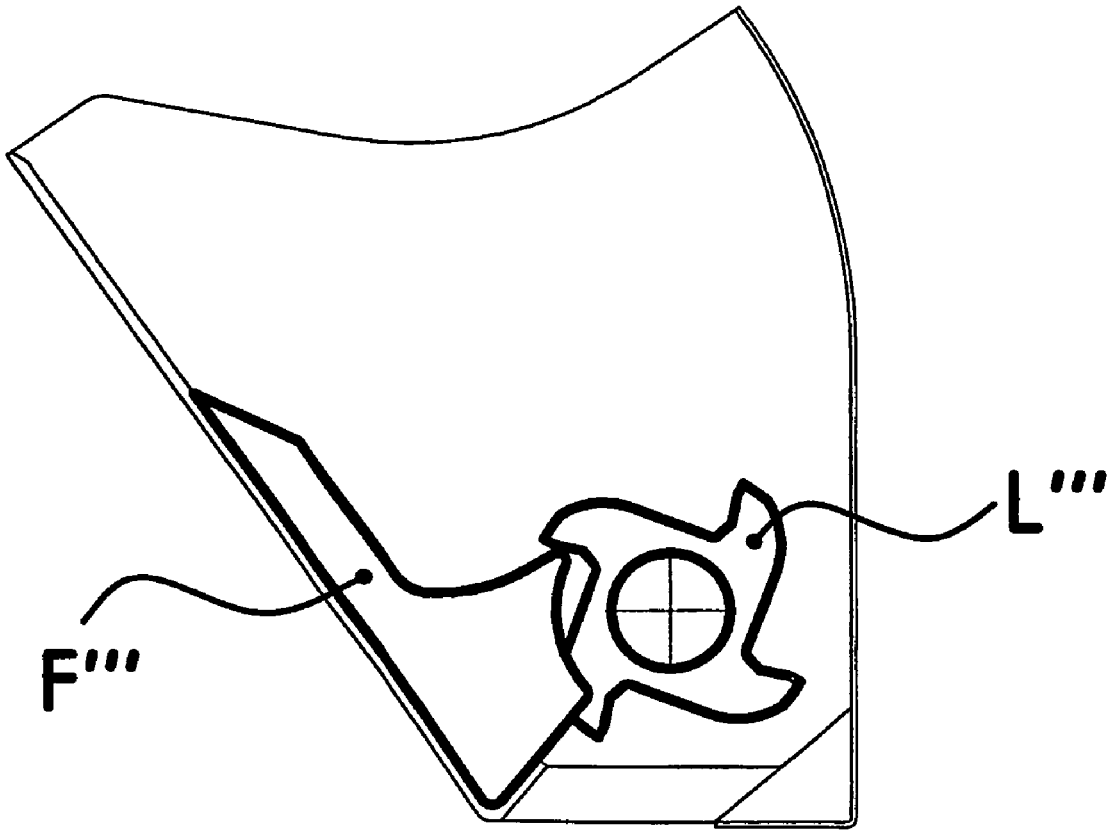
FIG. 4 shows schematically in a transverse section another bucket.

FIG. 4 shows schematically in transversal section a bucket with the rotor provided with four crushing blades (L'") that interact with the matching fixed plates (F'").

Figure 5:
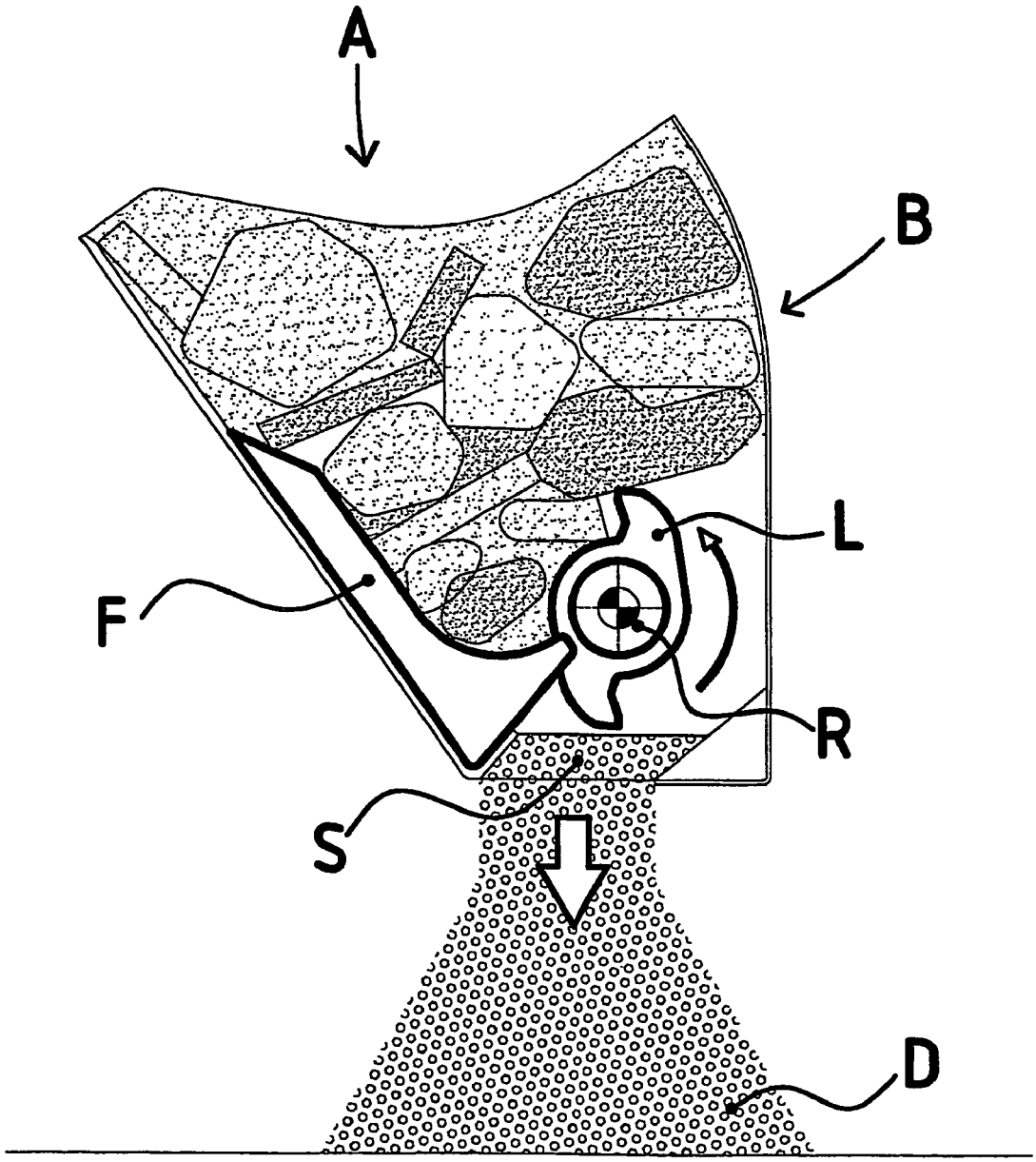
FIG. 5 shows a bucket during a crushing operation.

FIG. 5 shows a bucket (B) during the crushing operation of the various material and the emptying out of the resulting debris (D).

Figure 6:
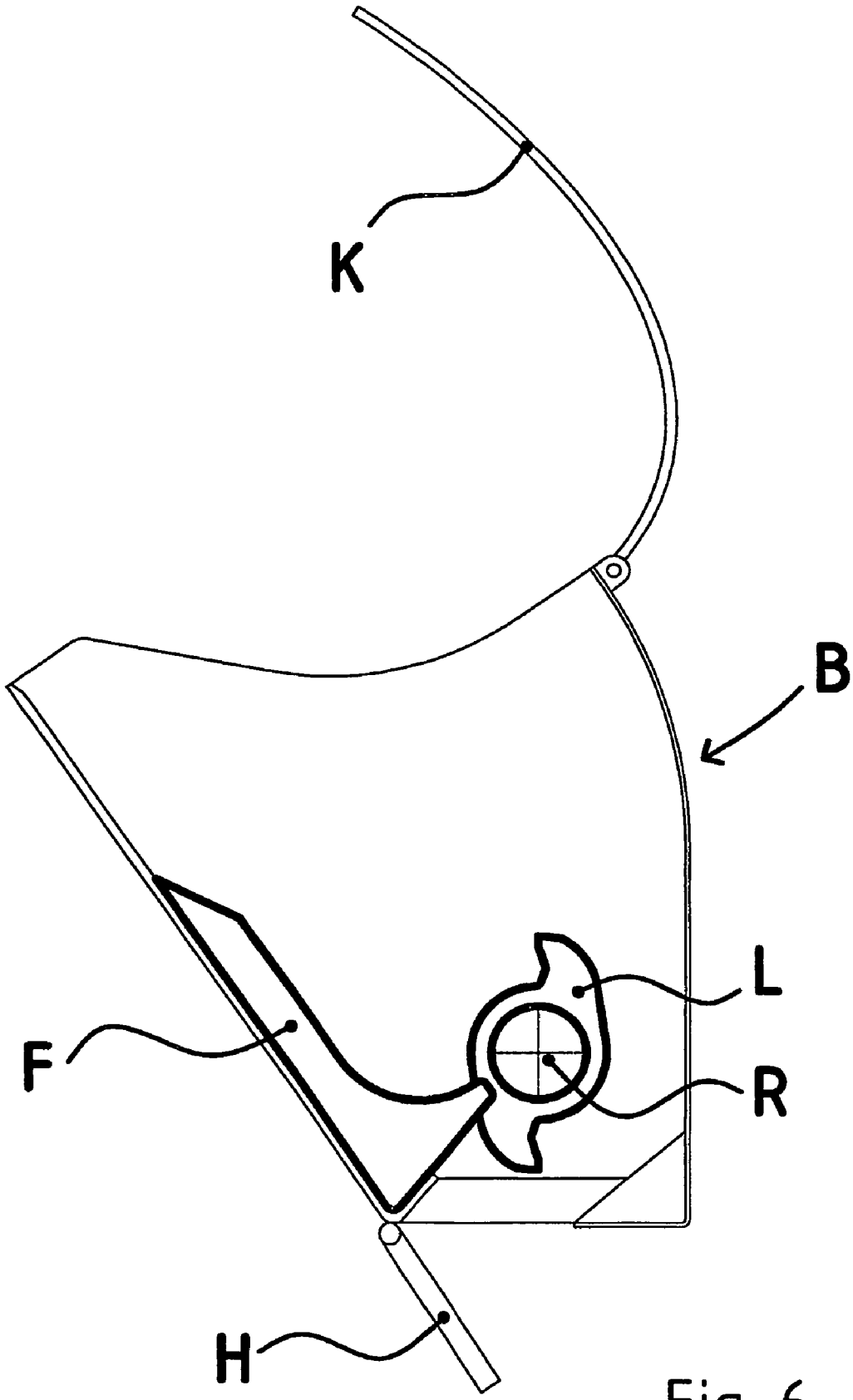
FIG. 6 shows schematically in a transverse section another bucket.

FIG. 6 shows schematically in section a bucket (B) provided with an upper lid (K) closing the feeding opening and a lid (H) closing the emptying out mouth.

Figure 7:
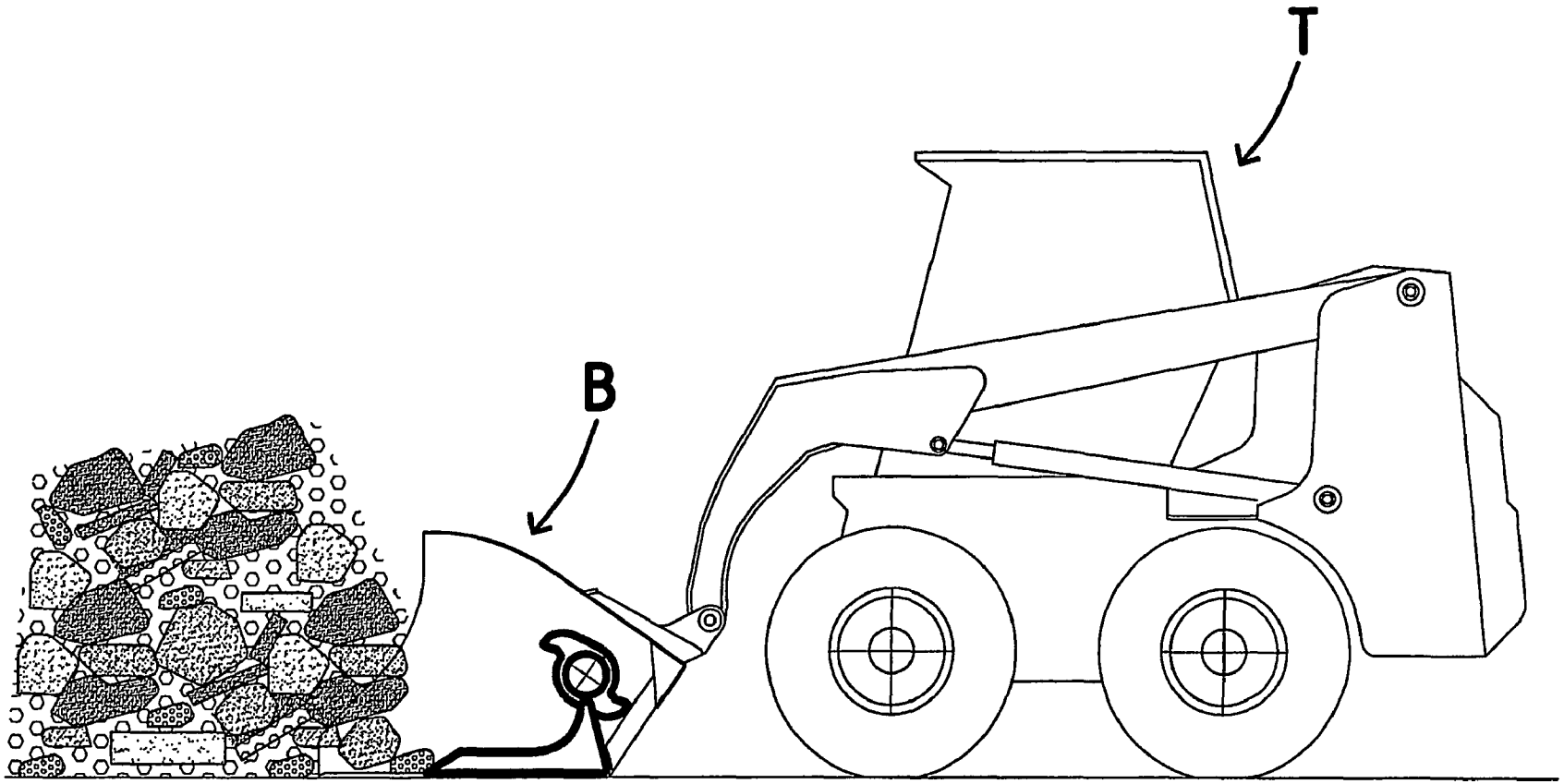
FIG. 7 shows an operating machine equipped with a bucket.

FIG. 7 shows an operating machine (T) equipped with a bucket (B) in loading position.

Figure 8:
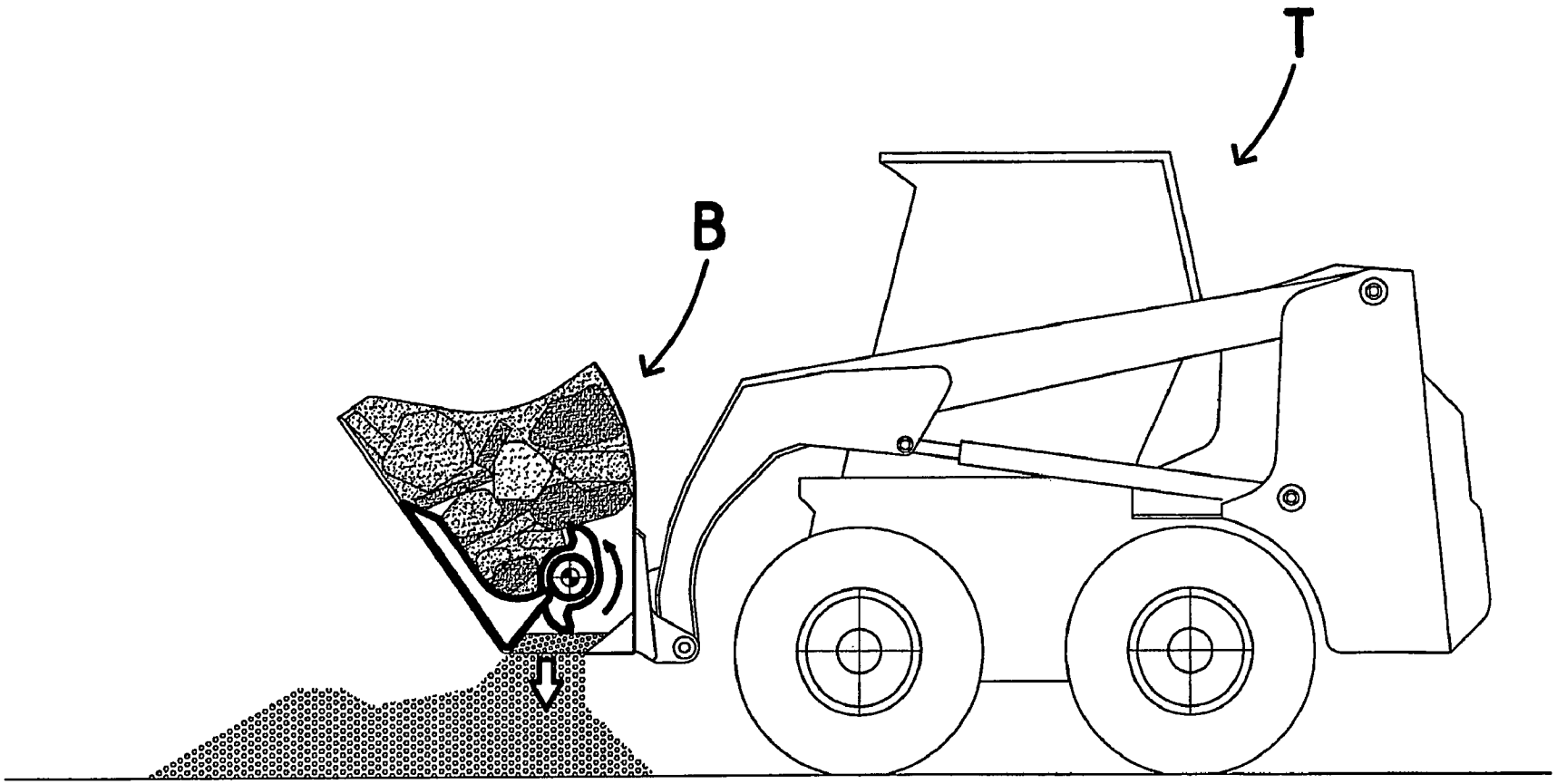
FIG. 8 shows an operating machine equipped with a bucket.

FIG. 8 shows an operating machines (T) provided with a bucket (B) in the position of crushing the previously loaded material.

Figure 9:
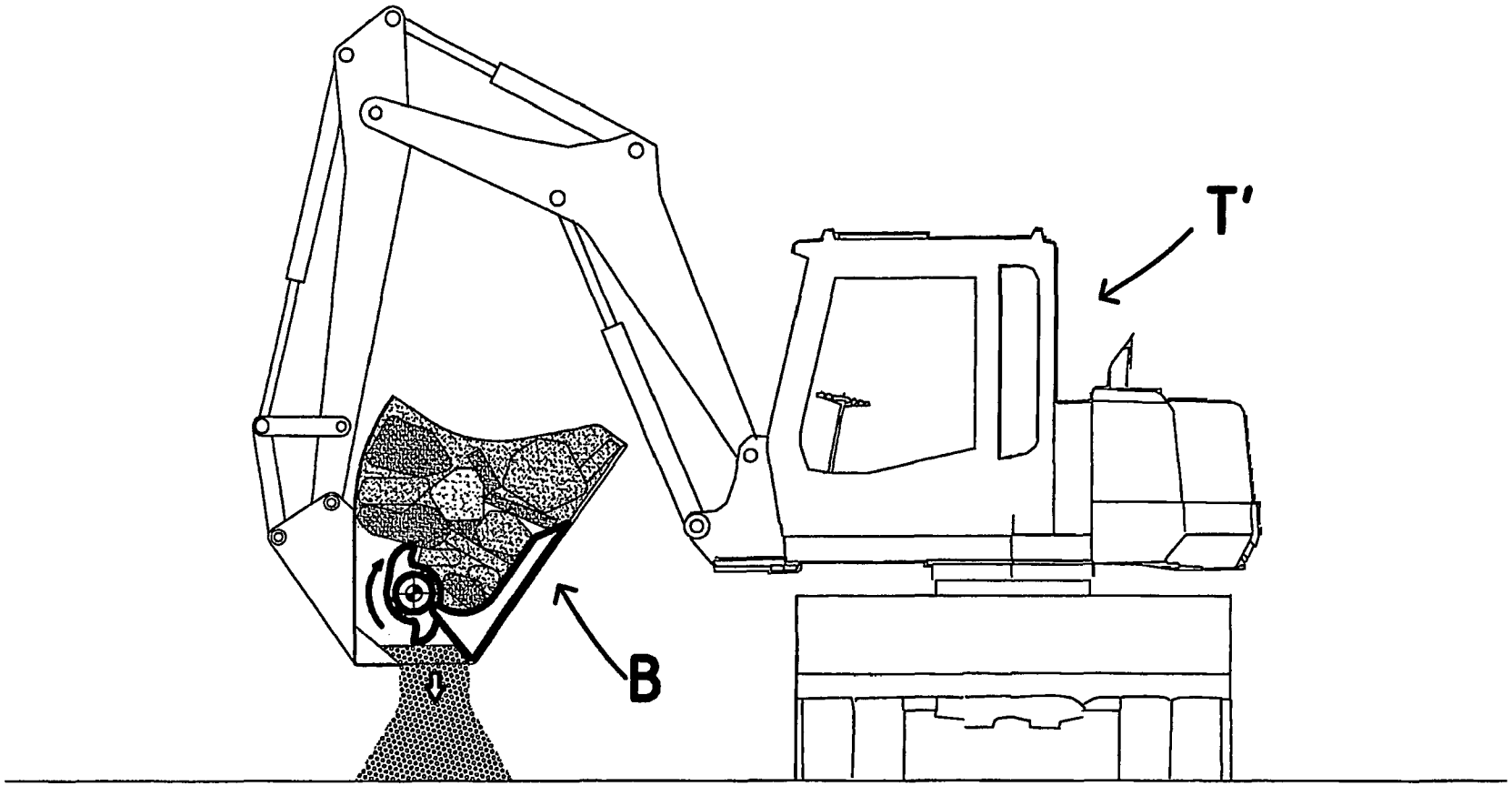
FIG. 9 shows an operating machine equipped with a bucket.

FIG. 9 shows an operating machine (T') with the bucket (B), working towards the operating machines, in operating position of crushing the previously loaded material.

Figure 10:
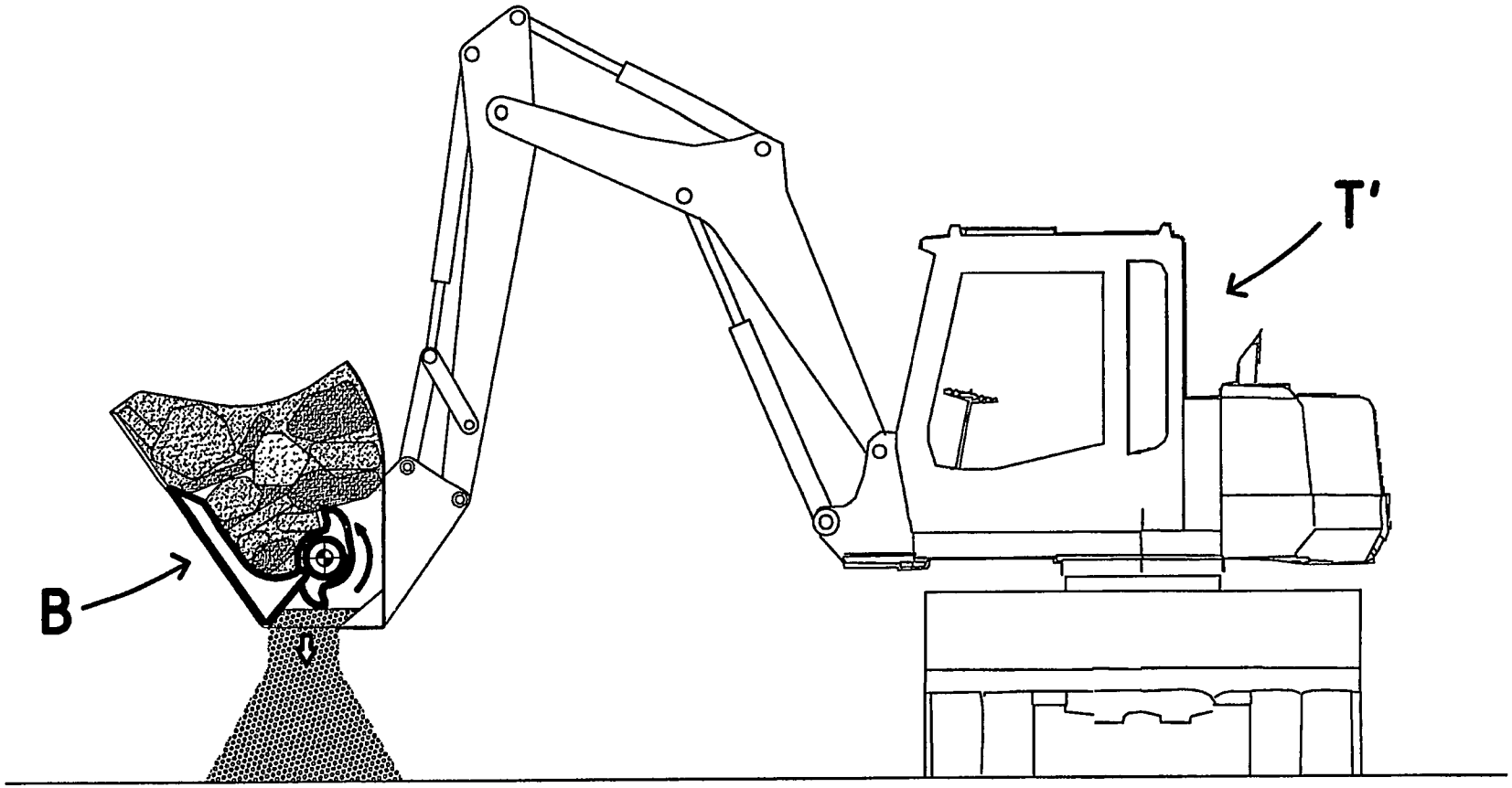
FIG. 10 shows an operating machine equipped with a bucket.
Figures 11A, 11B, 11C, 11D, 11E:
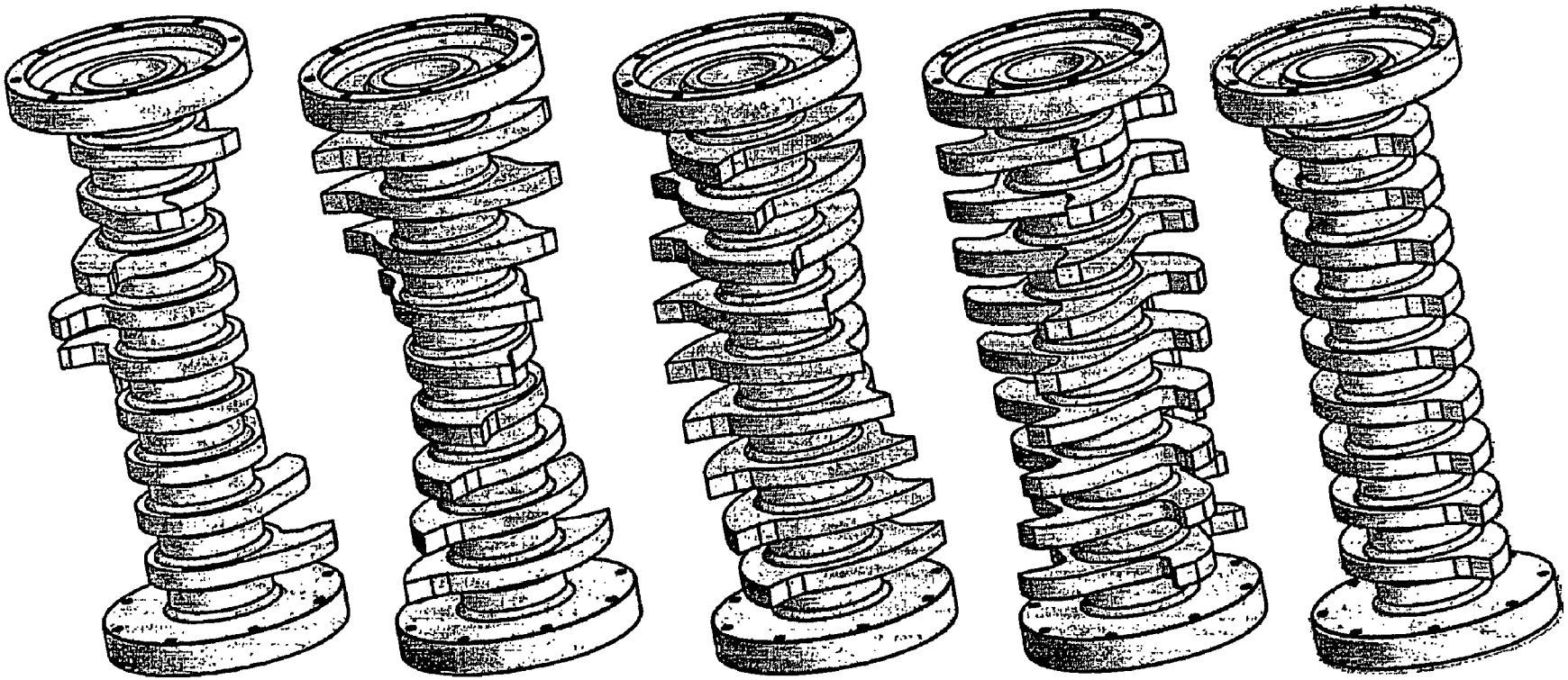
FIG. 11 *a-e* shows some examples of different types of crushing blades.

FIG. 10 shows an operating machine (T') equipped with the bucket (B) that works in the opposite direction.

FIGS. 11*a*, 11*b*, 11*c*, 11*d* and 11*e* show some examples of different type of crushing blades located on the rotor in a different number and different fashion.

Figure 12:
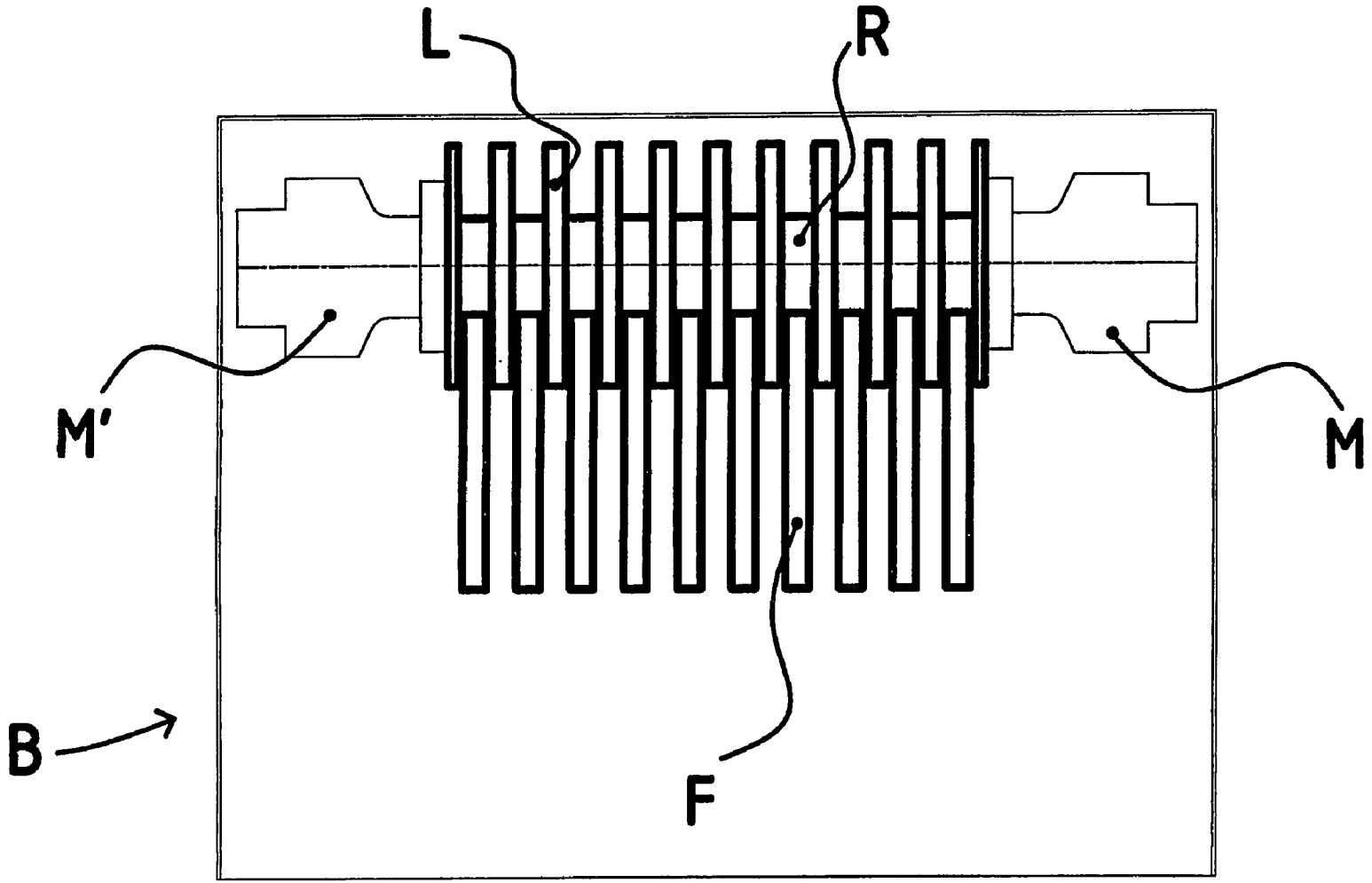
FIG. 12 shows schematically a bucket equipped with a rotor provided with crushing blades interacting with their respective fixed plates.

FIG. 12 shows schematically in plant the bucket (B) equipped with a rotor (R) provided with crushing blades (L) interacting with their respective fixed plates (F). It can be noticed that the rotor (R) is actuated by two engines or by two hydraulic or electric rotors (M, M'), both inside the body of the bucket (B).

Figure 13:
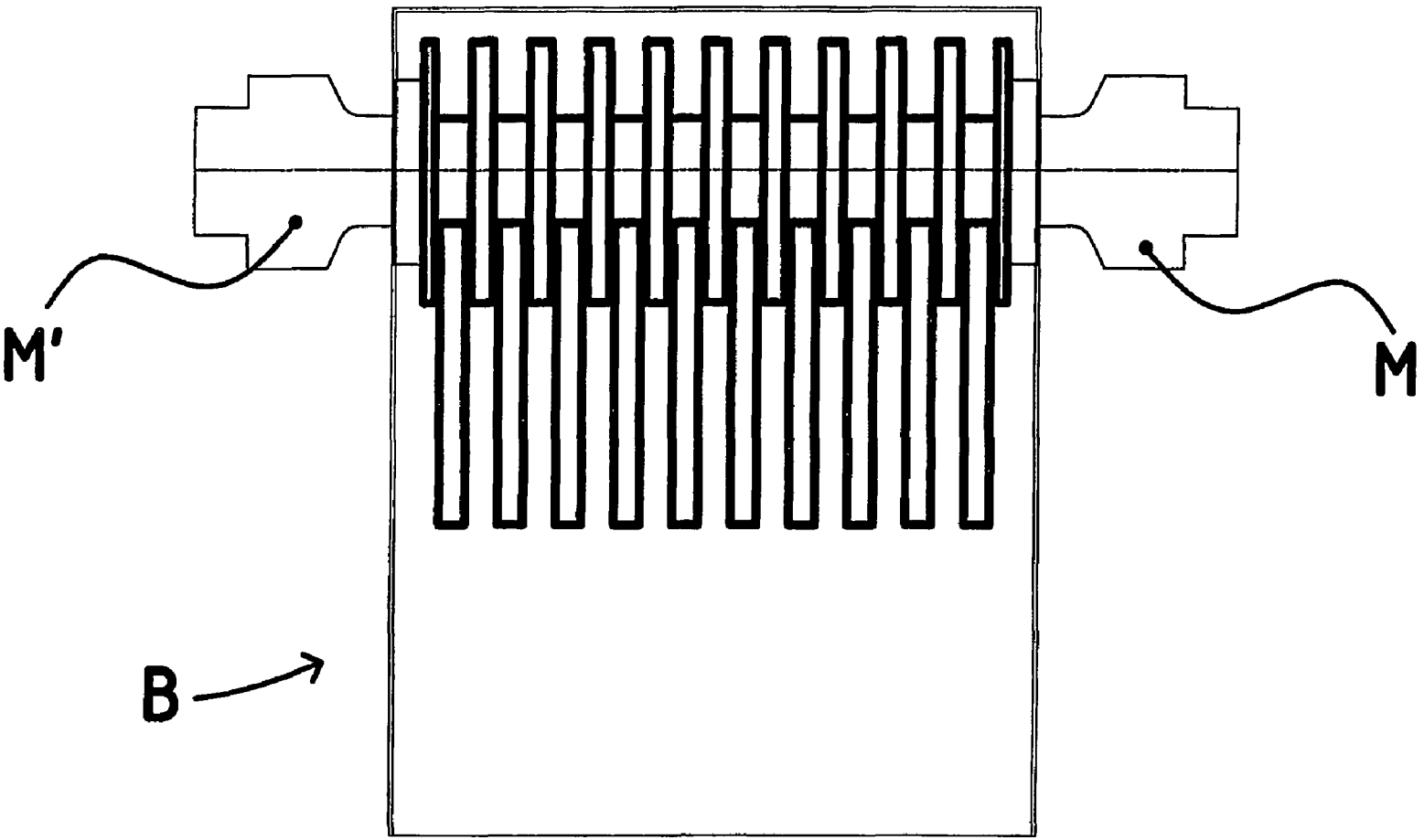
FIG. 13 shows schematically the application of two motors.

FIG. 13 shows schematically the application of two motors or rotors (M, M') outside the body of the bucket (B).

Figure 14:
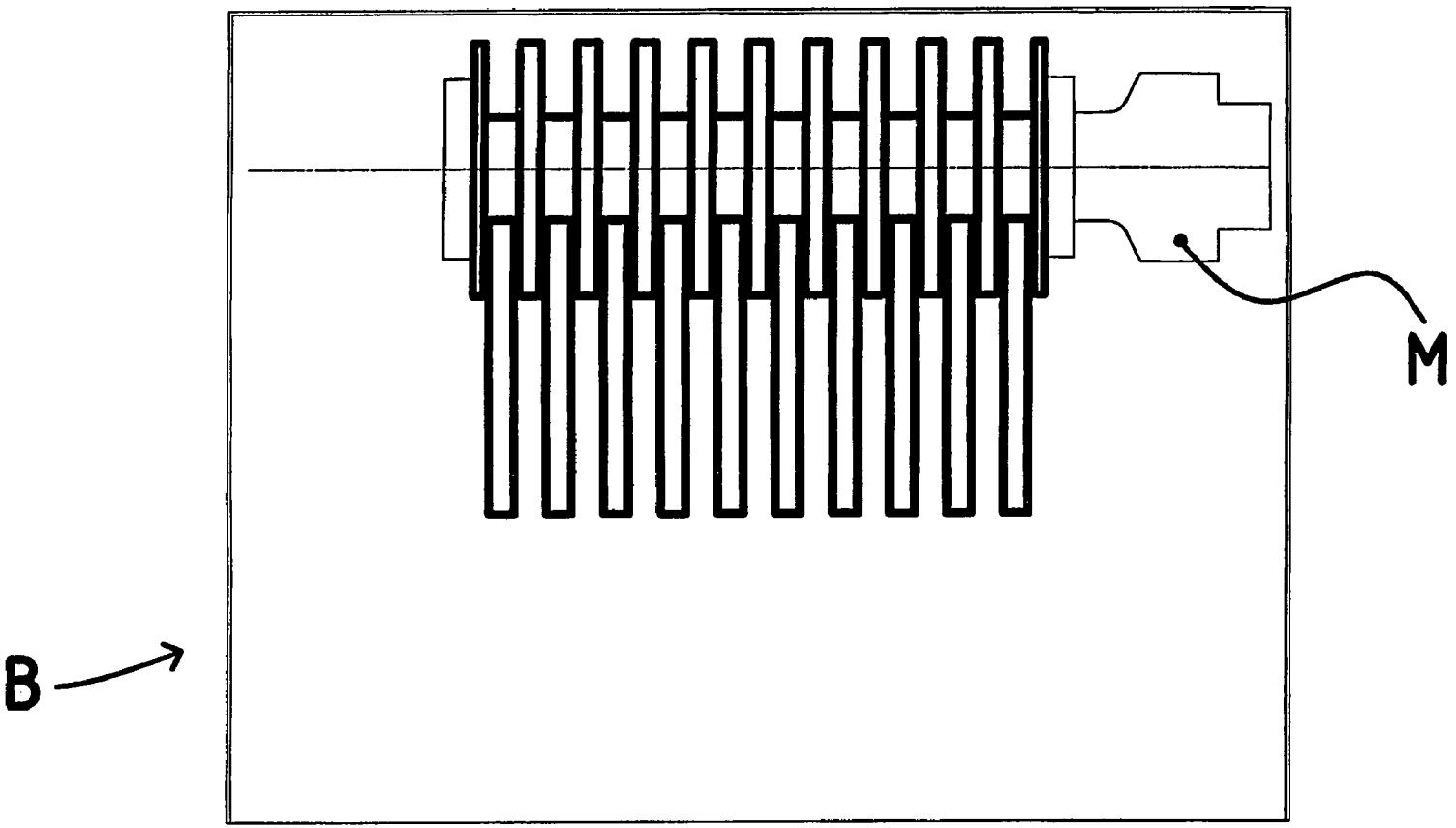
FIG. 14 shows schematically the application of single engine.

FIG. 14 shows schematically the application of a single engine or rotor (M) inside the bucket (B).

Figure 15:
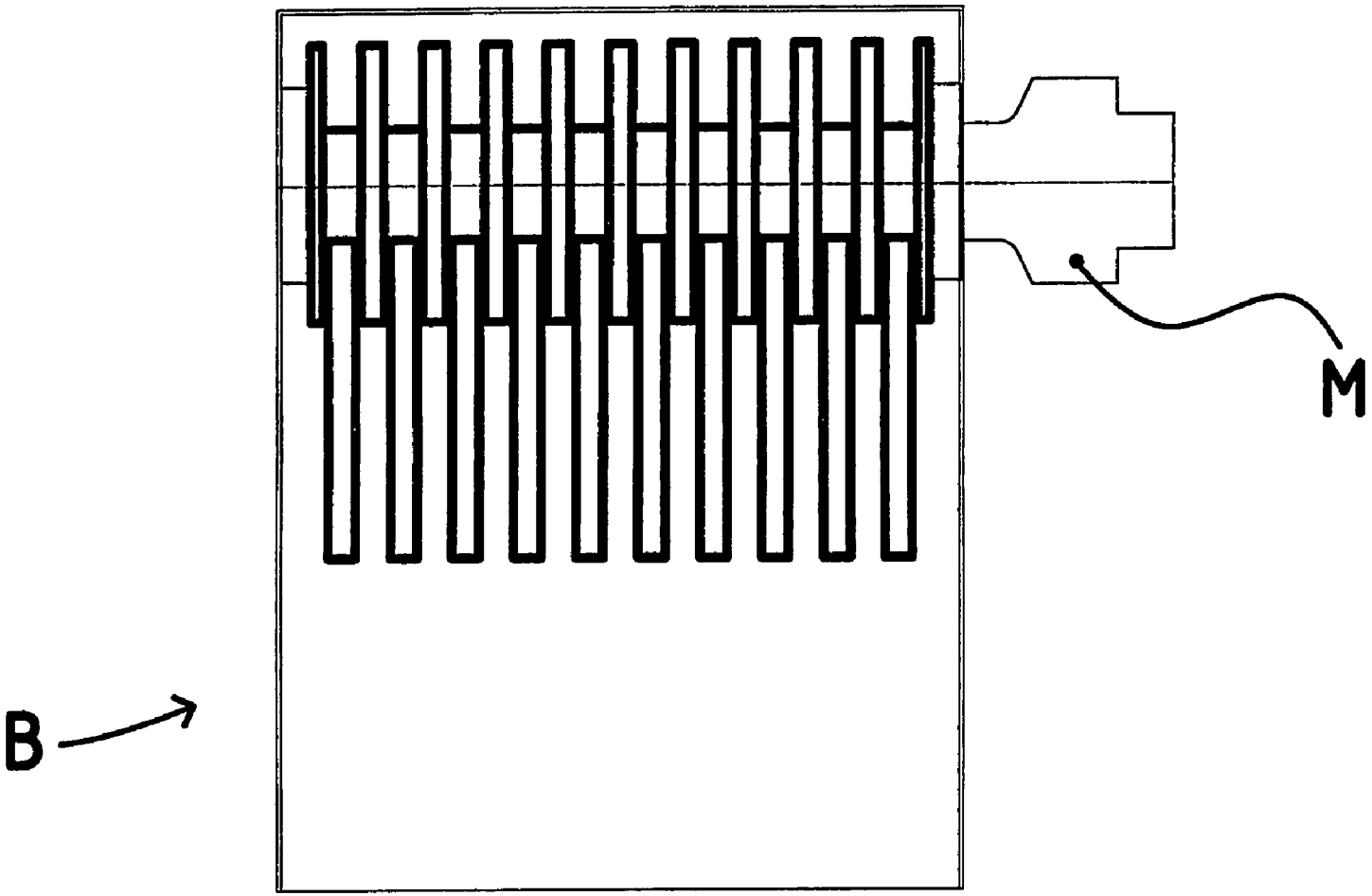
FIG. 15 shows schematically the application of single engine.

FIG. 15 shows schematically the application of a single engine or rotor (M) outside the bucket (B).

Figure 16:
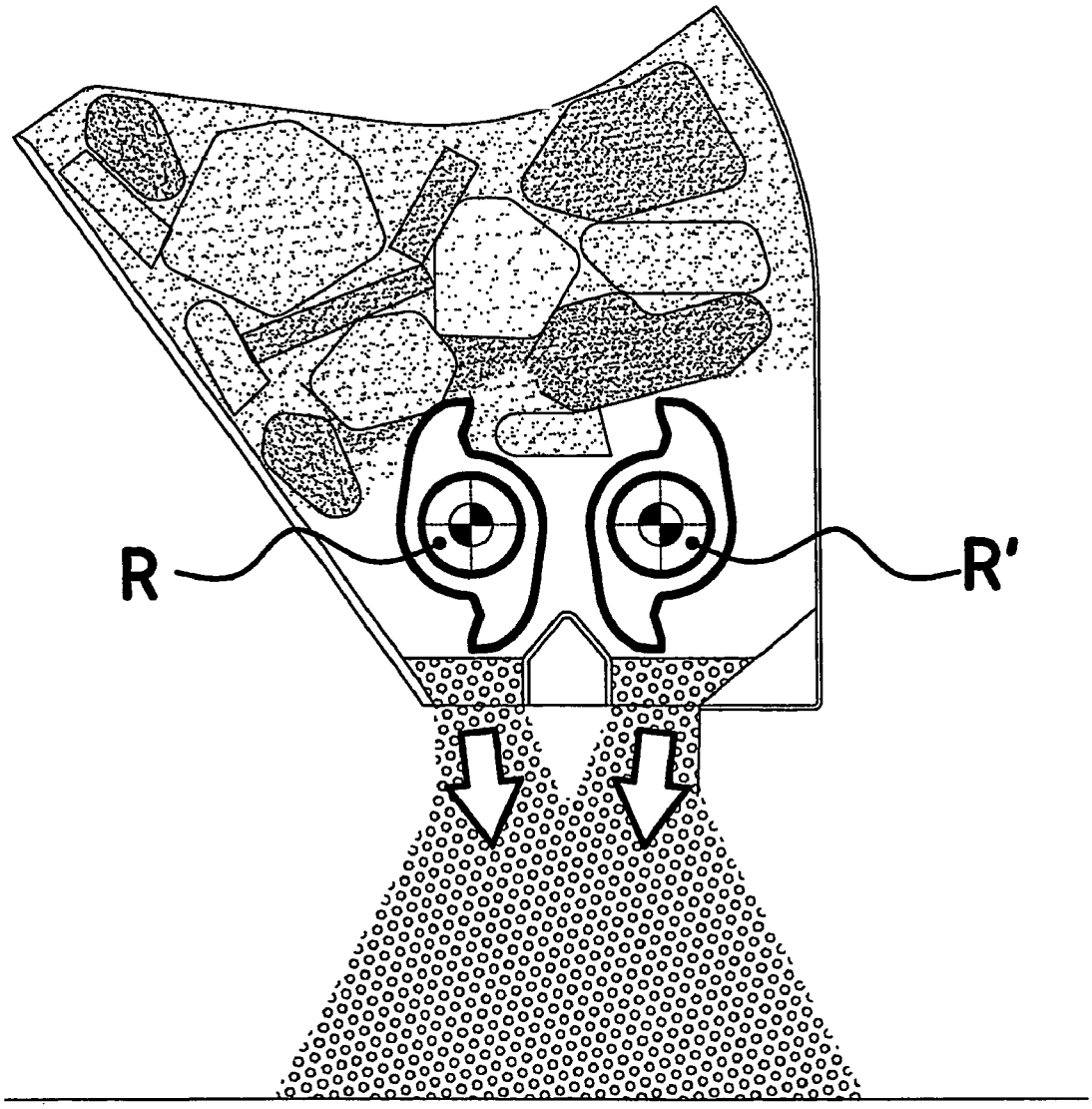
FIG. 16 shows schematically a bucket equipped internally with two rotors.
Figure 17A:
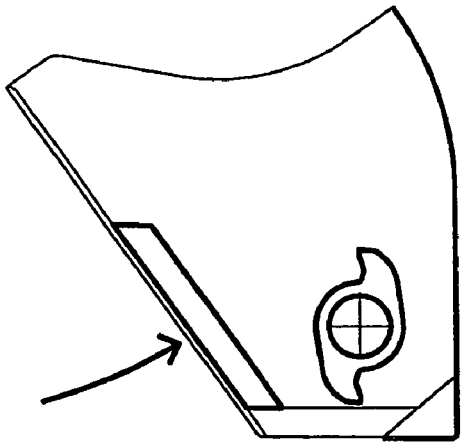
FIGS. 17*a-d* show schematically a bucket whose fixed plates are respectively replaced by different shapes, either fixed, moving or rotating.
Figure 17B:
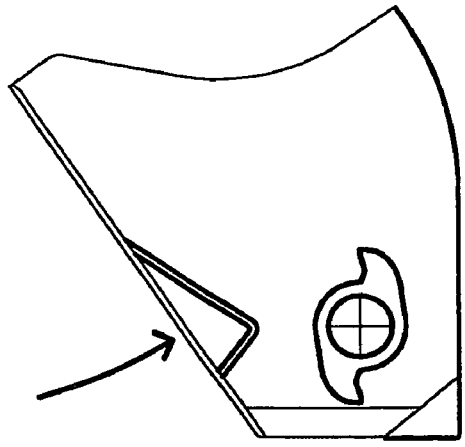
Figure 17C:
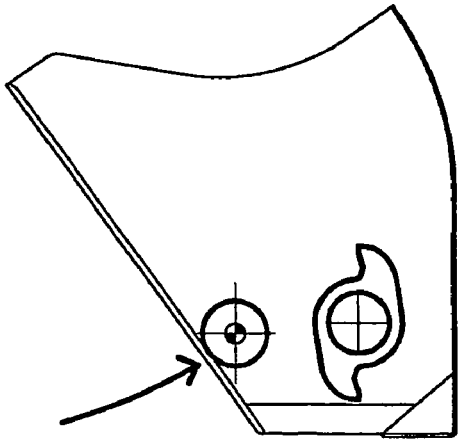
Figure 17D:
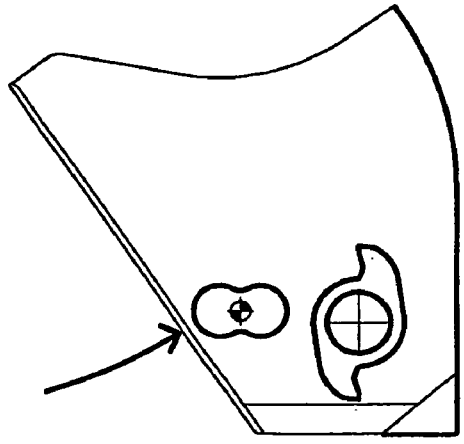

FIG. 16 shows schematically a bucket equipped internally with two rotors (R, R').

FIG. 17*a*, 17*b*, 17*c*, 17*d* show schematically a bucket whose fixed plates are respectively replaced by a flat surface, or by a shaped surface, or by a cylindrical surface, or by different shapes, either fixed, moving or rotating.

The clearness of the figures highlights the executive and operative simplicity of the present invention, which wholly solves all the technical problems ensuring a security and total functioning reliability, coupled with a extreme affordability in the practical realization.

Now that the original inventive features of the present invention have been disclosed, any average technician skilled in this specific technological field will be able to realize, with simple logical deductions and without any inventive effort, buckets that are interchangeably applicable to operating machines provided with hydraulic or electric plant, that rests either inside of the machine or nonetheless outside the bucket, that will present the very original features of the present invention as so far described, illustrated and hereinafter claimed.

The invention claimed is:

1. A bucket (B) having side walls and a lower emptying out mouth (S) that is applicable interchangeably to different operating machines, the bucket comprising a single rotor (R) upon which a plurality of blades (L) are applied, which interact interstitially with respective ones of a plurality of fixed plates (F), each of the respective ones of the plurality of fixed plates (F) mounted on only one of the side walls adjacent the lower emptying out mouth (S), wherein the plurality of fixed plates (F) do not cover all of the lower emptying out mouth (S), said single rotor being actuated by a motor fed by a circuit resting inside one of the different operating machines.

2. A bucket (B), as in claim 1, wherein a size and shape of a debris (D) of a crushed material can be varied by selectively positioning the plurality of fixed plates (F) prior to operation.

3. A bucket (B), as in claim 1, wherein the plurality of blades (L) are different in number, placement, dimension and geometric shape.

4. A bucket, as in claim 1, wherein said plurality of blades (L) interact with the plurality of fixed plates (F), whereby a composition of a crushed material may be regulated.

5. A bucket, as in claim 1, wherein the motor (M) is applied inside the bucket.

6. A bucket, as in claim 1, wherein an upper opening (A) for opening of the bucket can be closed with a lid (K).

7. A bucket, as in claim 1, wherein the lower emptying out mouth (S) can be closed with a cover (H).

8. A bucket, as in claim 1, wherein the plurality of fixed plates (F) can be made of shaped surfaces.

9. An interchangeable bucket for crushing stones with different operating machines comprising:

a bucket having side walls and a lower emptying out mouth adapted to be attached to each of the different operating machines;

a plurality of matching fixed plates attached to an interior surface of only one of the side walls adjacent the lower emptying out mouth of said bucket, wherein the plurality of matching fixed plates do not cover all of the lower emptying out mouth;

a rotor placed within said bucket;

a plurality of crushing blades attached to said rotor, said plurality of crushing blades interacting interstitially with said plurality of matching fixed plates; and a motor coupled to said rotor and fed by a circuit resting inside one of the different operating machines;

whereby said bucket is applicable interchangeably to the different operating machines.

* * * * *